US012252842B2

(12) United States Patent
Zhang et al.

(10) Patent No.: US 12,252,842 B2
(45) Date of Patent: Mar. 18, 2025

(54) ENERGY DISSIPATING FIBER/FABRIC AND THE METHOD OF MAKING THE SAME

(71) Applicant: Nano and Advanced Materials Institute Limited, Hong Kong (CN)

(72) Inventors: Kang Zhang, Hong Kong (CN); Christopher Cheung Yec, Hong Kong (CN); Jian Zhang, Hong Kong (CN); Shilong Zhang, Hong Kong (CN); Xiyao Zhang, Hong Kong (CN); Jifan Li, Hong Kong (CN)

(73) Assignee: Nano and Advanced Materials Institute Limited, Hong Kong (CN)

( * ) Notice: Subject to any disclaimer, the term of this patent is extended or adjusted under 35 U.S.C. 154(b) by 159 days.

(21) Appl. No.: 17/664,708

(22) Filed: May 24, 2022

(65) Prior Publication Data

US 2022/0380977 A1 Dec. 1, 2022

Related U.S. Application Data

(60) Provisional application No. 63/194,893, filed on May 28, 2021.

(51) Int. Cl.

| | |
|---|---|
| ***D06N 3/12*** | (2006.01) |
| ***D01D 5/08*** | (2006.01) |
| ***D01F 1/10*** | (2006.01) |

(52) U.S. Cl.

CPC ..... *D06N 3/128* (2013.01); *D01D 5/08* (2013.01); *D01F 1/10* (2013.01); *D10B 2401/06* (2013.01)

(58) Field of Classification Search

CPC ..... D06N 3/128; D06N 3/02; D06N 3/04; D06N 3/047; D06N 3/0034; D06N 2203/066; D06N 2209/103; D01D 5/08; D01D 5/0023; D01F 1/10; D01F 6/46; D10B 2401/06

See application file for complete search history.

(56) References Cited

U.S. PATENT DOCUMENTS

| | | | | |
|---|---|---|---|---|
| 2009/0163098 | A1* | 6/2009 | Ardiff | F41H 5/0471 2/2.5 |
| 2020/0248338 | A1 | 8/2020 | Lundin et al. | |
| 2020/0379166 | A1* | 12/2020 | Kanik | C03C 13/046 |
| 2021/0355306 | A1* | 11/2021 | Green | C08L 83/08 |
| 2023/0242700 | A1* | 8/2023 | Kang | D06P 3/028 8/543 |
| 2023/0364843 | A1* | 11/2023 | Michihira | B29C 48/05 |

FOREIGN PATENT DOCUMENTS

| | | | | |
|---|---|---|---|---|
| CN | 111183185 | A | 5/2020 | |
| CN | 111804249 | A * | 10/2020 | B01J 13/02 |
| WO | WO-2019072186 | A1 * | 4/2019 | C08G 18/66 |

OTHER PUBLICATIONS

First Office Action of CN2022105955850 issued from the China National Intellectual Property Administration on Jun. 8, 2023.

* cited by examiner

*Primary Examiner* — S. Behrooz Ghorishi
(74) *Attorney, Agent, or Firm* — S&F/WEHRW

(57) ABSTRACT

An energy dissipating fiber and fabric for protective textile application, which can absorb energy during shocking, stretching and vibration. The disclosed fiber/fabric can include a polymer matrix, a shear-thickening material and a reinforcing filler.

7 Claims, 4 Drawing Sheets

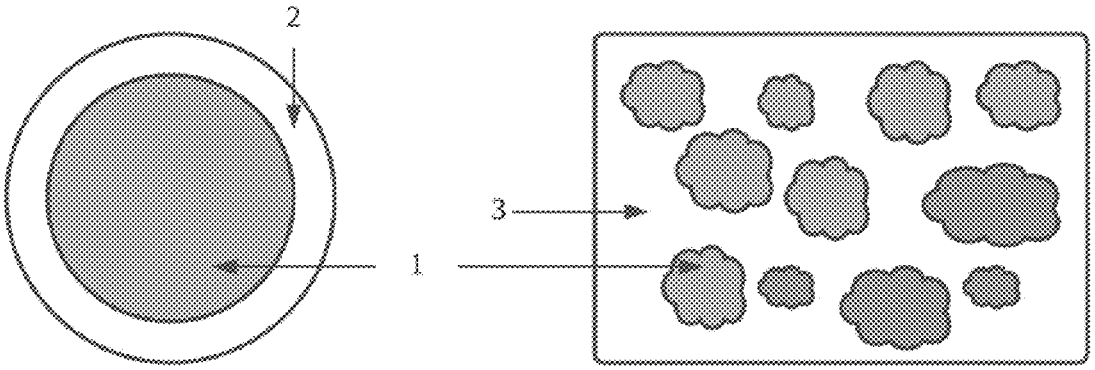
FIG. 1A
FIG. 1B
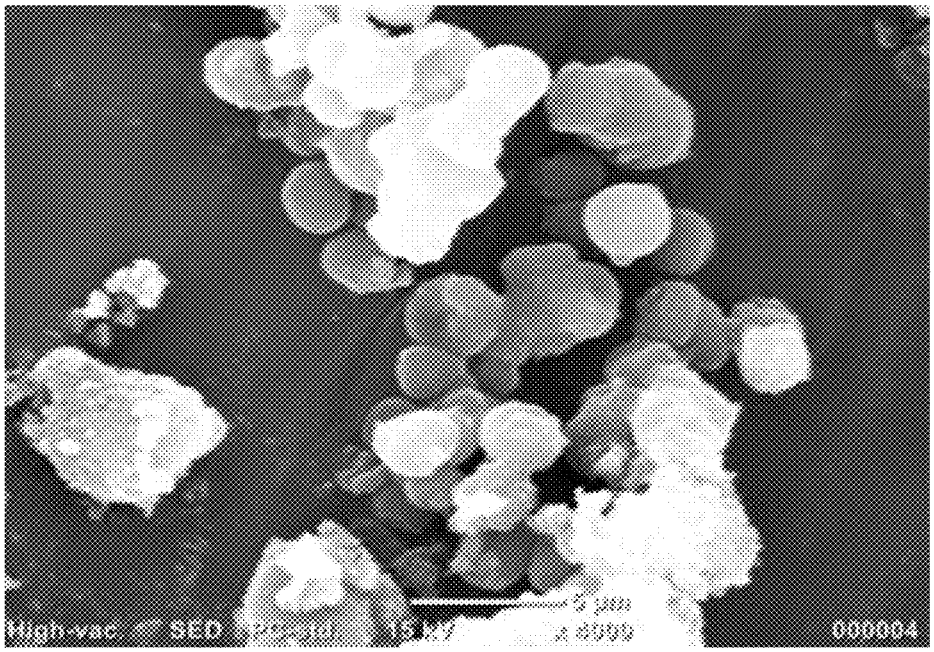
FIG. 2

ENERGY DISSIPATING FIBER/FABRIC AND THE METHOD OF MAKING THE SAME

CROSS-REFERENCE TO RELATED APPLICATIONS

The present application claims priority from U.S. Provisional Patent Application No. 63/194,893, filed on May 28, 2021, which is hereby incorporated by reference in its entirety.

TECHNICAL FIELD

The present disclosure relates to an energy dissipating fiber/fabric that could absorb energy under the situation of mechanical shock, stretching or vibration, providing excellent protection performance in the application of textile.

BACKGROUND

Conventional fibers used in daily life include cotton, wool, nylon, polyester and so on. Driven by special technical functions that require specific physical properties unique to the conventional fiber, effort has been made on developing high performance fibers. The main types of high-performance fibers are carbon fiber, aramid fiber, ultra-high molecular weight polyethylene fiber, polybenzoxazole (PBO), polybenzimidazole (PBI) fiber, glass fiber, etc. These high-performance fibers are mostly synthetic fibers with very high strength and high modulus due to their highly oriented molecular chains along the fiber direction. However, these high-performance fibers usually possess low toughness which means that the ability of fiber to absorb energy is poor.

U.S. Pat. No. 7,498,276 teaches an energy absorbing fabric comprising a shear thickening fluid, which provides improved ballistic and/or puncture resistance. The shear thickening fluid is a relatively low viscosity liquid, which may lead to leakage during application to fabric, and is prone to moisture absorption that may lead to variations in performance of treated fabric.

U.S. Pat. No. 10,408,294 teaches an aramid based ballistic performance material treated with a composite material comprising polyurethane, silicone, and a thermoplastic elastomer. U.S. Pat. No. 10,408,294 is restricted to aramid textiles, which limits use in conventional textile materials.

Energy absorbing fibers/fabrics and textiles treating with energy absorbing materials should also exhibit desired mechanical properties, such as toughness of the fiber/fabric, and energy absorption performance while stretching As a result, there is a need for improved methods for preparing energy dissipating fibers and products thereof that overcome at least some of the aforementioned disadvantages.

SUMMARY

The present disclosure provides an energy dissipating fiber/fabric and the method of making the same. More specifically, the fiber mainly comprises a polymer matrix, a shear-thickening material and a reinforcing filler. In certain embodiments, the shear thickening material are dilatant materials or shear thickening fluid consisting of two-phase dispersions for which the particles are dispersed in medium fluid. In certain embodiments, the shear thickening material is encapsulated by polymer in the shape of sphere like core-shell structure or irregular structure. The reinforcing filler selected to facilitate the polymer chain crystallization and orientation during the fiber spinning and drawing process. In certain embodiments, the reinforcing fillers are organic nucleating agent or inorganic nucleating agents. The fiber can be prepared by melt or extrusion spinning process via a spinneret. And then the fiber could be weaved or knitted into energy dissipating fabric for specific application. Another method for the fabrication of the aforementioned energy dissipating fabric could be combining the encapsulated shear thickening material together with the fabric substrate by coating or lamination.

In a first aspect, provided herein is a method of preparing an energy dissipating fiber or fabric comprising:

a) mixing a polymer matrix, a shear thickening material, a reinforcing filler and optionally an antioxidant together;

b) feeding the composite obtained from step (a) into a melt or extrusion spinning machine to form the energy dissipating fiber; and c) optionally weaving or knitting the fiber obtained from step (b) into the energy dissipating fabric.

In certain embodiments, the polymer matrix, the shear thickening material, the reinforcing filler, and the antioxidant is mixed in a weight ratio between 100:0.1:0.1:0.1 to 100:100:100:10, respectively.

In certain embodiments, the polymer matrix comprises polyethylene, polypropylene, polyamide, polyethylene terephthalate, polycarbonate, polylactide, acrylonitrile butadiene styrene, polystyrene, or a combination thereof.

In certain embodiments, the polymer matrix comprises ethylene vinyl acetate copolymer, ethylene-propylene diene rubber, polyurethane, silicone rubber, styrene-butadiene rubber, acrylonitrile-butadiene rubber, natural rubber, polychloroprene rubber, or combinations thereof.

In certain embodiments, the shear thickening material is a silicone polymer, a hydroxyl terminated dialkylsiloxane polymer, a borate cross-linked hydroxyl terminated dialkylsiloxane polymer, a silicone polymer comprising borated polydimethylsiloxane, polyborodimethylsiloxane (PBDMS), a metal oxide/polyethylene glycol dispersion, a metal oxide/poly(ethylene oxide), or combinations thereof.

In certain embodiments, the reinforcing filler comprises talc, boron nitride, calcium carbonate, magnesium carbonate, titanium oxide, carbon nanotube, ultra-high molecular weight polyethylene (PE), sisal fibers, high-modulus PE fiber, anthracene, potassium hydrogen phthalate, benzoic acid type compounds, sodium benzoate type compounds, zinc monoglycerolate, fumed silica, E-glass fiber, wollastonite, quartz, hydrophobic fumed silica, diatomaceous earth, calcium carbonate, or combinations thereof.

In certain embodiments, the polymer matrix, the shear thickening material, the reinforcing filler and optionally an antioxidant are present in the composite in a weight ratio between 100:0.1:0.1:0 to 100:100:100:10, respectively.

In certain embodiments, the method further comprises the step of mixing a compatibilizer, a lubricant, a plasticizer, a dye, or combinations thereof in step (a).

In certain embodiments, the shear thickening material is an encapsulated shear thickening material comprising a shell at least partially encapsulating a core, wherein the core comprises the shear thickening material and the shell comprises an encapsulated material; or the encapsulated shear thickening material comprises a dispersed phase and a continuous phase, wherein the disperse phase comprises the shear thickening material and the continuous phase comprises an encapsulated material.

In certain embodiments, the shear thickening material is a silicone polymer, a hydroxyl terminated dialkylsiloxane polymer, a borate cross-linked hydroxyl terminated dialkylsiloxane polymer, a silicone polymer comprising borated polydimethylsiloxane, PBDMS, a metal oxide/polyethylene glycol dispersion, a metal oxide/poly(ethylene oxide), and combinations thereof.

In certain embodiments, the encapsulated material comprises polystyrene, allyl methacrylate, polyurethane, sodium alginate, silicone rubber, polyvinyl alcohol, or combinations thereof.

In certain embodiments, the shear material and the encapsulated material are present in a weight ratio between 1:100 to 300:100, respectively.

In a second aspect, provided herein is a method of preparing an energy dissipating fabric comprising: coating or laminating a fabric substrate with a composite comprising a polymer matrix, a reinforcing filler, and an encapsulated shear thickening material thereby forming the energy dissipating fabric, wherein the encapsulated shear thickening material comprises a shell at least partially encapsulating a core, wherein the core comprises a shear thickening material and the shell comprises an encapsulated material; or the encapsulated shear thickening material comprises a dispersed phase and a continuous phase, wherein the disperse phase comprises the shear thickening material and the continuous phase comprises an encapsulated material.

In certain embodiments, the shear thickening material is a silicone polymer, a hydroxyl terminated dialkylsiloxane polymer, a borate cross-linked hydroxyl terminated dialkylsiloxane polymer, a silicone polymer comprising borated polydimethylsiloxane, PBDMS, a metal oxide/polyethylene glycol dispersion, a metal oxide/poly(ethylene oxide), and combinations thereof.

In certain embodiments, the encapsulated material comprises at least one selected from the group consisting of polystyrene, allyl methacrylate, polyurethane, sodium alginate, silicone rubber, polyvinyl alcohol, and combinations thereof.

In certain embodiments, the shear material and the encapsulated material is present in a weight ratio between 1:100 to 300:100, respectively.

In certain embodiments, the fabric comprises cotton, polyester, nylon, acrylic, carbon fabric, aramid fabric, ultra-high molecular weight polyethylene fabric, spandex, or combinations thereof.

In certain embodiments, the coating or laminating step further comprises coating or laminating a binder on the fabric substrate.

In certain embodiments, the binder comprises a polytetrafluoroethylene (PTFE), a polyacrylonitrile (PAN), a polyvinylpyrrolidone (PVP), a poly(vinyl alcohol) (PVA), and a carboxymethyl cellulose (CMC), or combinations thereof.

BRIEF DESCRIPTION OF THE DRAWINGS

The invention may be further understood from the following description on non-limitative examples, with reference to the accompanying drawings, in which:

FIG. 1A shows a cross-sectional view of a typical encapsulated shear thickening material with core-shell structure (1: shear thickening material, 2: polymer shell).

FIG. 1B shows a cross-sectional view of a typical encapsulated shear thickening material with shear thickening material as dispersed phase and polymer matrix as continuous phase (1: shear thickening material, 3: polymer matrix).

FIG. 2 shows a scanning electron microscopy (SEM) image of encapsulated shear thickening material for which polymethylmethacrylate (PMMA) is the shell material and PBDMS is in the core.

DETAILED DESCRIPTION

Figure 3:
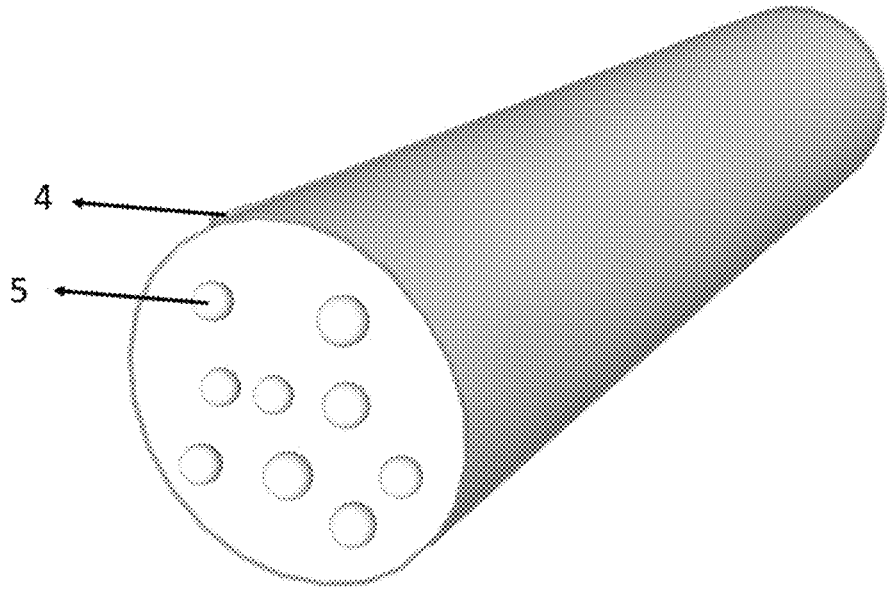
FIG. 3 shows a cross-sectional view of a typical energy dissipating fiber (4: polymer matrix; 5: encapsulated shear thickening material with core-shell structure

Provided herein are energy dissipating fiber/fabric having good energy absorption ability during mechanical shock, stretching or vibration. The energy dissipating fiber described herein can be prepared using melt or extrusion spinning of composite of polymer, shear thickening material and reinforcing fillers and the resulting fiber can have better mechanical and dynamic properties than the fiber using pure polymer matrix. Depending on the desired physical and chemical properties of the resulting energy dissipating fiber, a person skilled in the art can select the appropriate polymer matrixes. Exemplary, polymer matrixes include thermoplastic resin such as polyethylene, polypropylene, polyamide and polyethylene terephthalate. In certain embodiments, polymer matrixes could be elastomers such as ethylene vinyl acetate copolymer, ethylene-propylene diene rubber, polyurethane, silicone rubber, styrene-butadiene rubber, acrylonitrile-butadiene rubber, natural rubber, and polychloroprene rubber.

The shear thickening material can be shear thickening fluid or dilatant. In certain embodiments, the dilatant is a borate cross-linked hydroxyl terminated dialkylsiloxane polymer (PBDMS); In certain embodiments, the dilatant is PBDMS prepared from 2,000 to 5,000 Dalton hydroxyl terminated dimethylsiloxane polymer. In certain embodiments, the dilatant is shear thickening fluid in which the particles are dispersed in a fluid medium; The particles may be metal oxide such as SiO2, or non-oxide particles such as calcium carbonate, or organic particles such as polymethylmetharylate. The fluid medium could be selected from organic polymers with varing molecular weights such as polyethylene glycol, polyethylene oxide, polypropylene glycol, siloxanes and paraffin. In certain embodiments, 1D/2D functional additives with certain length/diameter (L/D) or radius/thickness (R/T) ratio could be added into the shear thickening fluid to enhance its dynamic property. These 1D/2D materials could be short cut fibers (polypropylene, polyester, polyvinylalcohol, polyacrylonitrile), carbon boron nitride nanotubes (BNNTs), SiC nanowires, metal oxide whiskers, graphene or MXenes.

The shear thickening material can be a kind of shear thickening materials encapsulated by polymer. In certain embodiments, the encapsulated shear thickening materials have a core-shell structure, for which the shear thickening material is the core and polymer is the shell material as shown in FIG. 1A. In certain embodiments, the shell polymer could be polystyrene, allyl methacrylate, polyurethane, sodium alginate and combinations thereof. In certain embodiments, the encapsulated shear thickening material could be a composite in which shear thickening material is the dispersed phase while a polymer such as silicone rubber, polyurethane, polyvinyl alcohol is the continuous phase as shown in FIG. 1B.

The encapsulated shear thickening material with a core-shell structure can be prepared by mixing the shear thickening material with monomer, cross linker, initiator, surfactants and water together with a certain speed in the homogenizer and then the polymerization process of the shell polymer will be done by heating the mixture at temperature between 60-80° C. for 4-8 hours. The core-shell encapsulated shear thickening material is then collected by filtering or spray drying from the emulsion. In certain embodiments, the size of core-shell encapsulated shear thickening material is around 2 μm as shown in the FIG. 2.

The reinforcing filler can be a nucleating agent or a strengthening filler. In certain embodiments, the nucleating agent could be talc, boron nitride, calcium carbonate, magnesium carbonate, titanium oxide, carbon nanotube, or organic additives such as ultra-high molecular weight PE, sisal fibers, high-modulus PE fiber, anthracene, potassium hydrogen phthalate, benzoic acid type compounds, sodium benzoate type compounds, zinc monoglycerolate. In certain embodiments, strengthening fillers could be fumed silica, E-glass fiber, wollastonite, quartz, hydrophobic fumed silica, diatomaceous earth, calcium carbonate, and combinations thereof.

Optionally, antioxidant can be added into the polymer composite during the fiber spinning or extrusion process to prevent the degradation of polymer. Several kinds of amines, phenolics, phosphites, thioesters etc. are employed as antioxidants. Exemplary, antioxidant can be selected from butylated hydroxytoluene, Irganox®1010, Irganox® 1076, Irganox® 1098, Irgafos® 168 or Irganox® B 225, and the like.

The energy dissipating fiber can be prepared by melt or extrusion spinning. In certain embodiments, the composite of polymer matrix, shear thickening material and reinforcing filler are melt blended and then placed in the charging barrel of the melt spinning equipment. Then the composite is melted and pumped through a spinneret with numerous holes. The molten fibers are cooled, solidified, and collected on a take-up wheel. In certain embodiments, the fiber can be obtained by extrusion spinning. The composite of polymer matrix, shear thickening material and reinforcing filler are fed into the extrusion machine in pellet/chips form, melted and then pressed through. After being extruded by the spinneret, the polymer solidifies into yarn-shape.

In certain embodiments, as shown in the energy dissipating fiber comprises the thermoplastic resin, the shear thickening material, and the reinforcing filler in a weight ratio between 100:0.1:0.1 to 100:100:100, respectively. In certain embodiments, as shown in the energy dissipating fiber comprises the thermoplastic resin, the encapsulated shear thickening material, and the reinforcing filler in a weight ratio between 100:0.1:0.1 to 100:100:100, respectively.

In certain embodiments, the energy dissipating fiber comprises the thermoplastic resin, the shear thickening material, the reinforcing filler and the optionally antioxidant in a weight ratio between 100:0.1:0.1:0.1 to 100:100:100:10, respectively. In certain embodiments, the energy dissipating fiber comprises the thermoplastic resin, the encapsulated shear thickening material, the reinforcing filler and the optionally antioxidant in a weight ratio between 100:0.1:0.1:0.1 to 100:100:100:10, respectively.

In certain embodiments, the energy dissipating fiber comprises the elastomer, the shear thickening material, and the reinforcing filler in a weight ratio between 100:0.1:0.1 to 100:100: 100, respectively. In certain embodiments, the energy dissipating fiber comprises the elastomer, the encapsulated shear thickening material, and the reinforcing filler in a weight ratio between 100:0.1:0.1 to 100:100:100, respectively.

In certain embodiments, the energy dissipating fiber comprises the elastomer, the shear thickening material, the reinforcing filler and the optionally antioxidant in a weight ratio between 100:0.1:0.1:0.1 to 100:100:100:10, respectively. In certain embodiments, the energy dissipating fiber comprises the elastomer, the encapsulated shear thickening material, the reinforcing filler and the optionally antioxidant in a weight ratio between 100:0.1:0.1:0.1 to 100:100:100:10, respectively.

The encapsulated shear thickening material described herein can be with core-shell structure with diameter from 10 nm to 50 μm. In certain embodiments, encapsulated shear thickening material is a composite in which the shear thickening material is the dispersed phase while a polymer such as silicone rubber, polyurethane, polyvinyl alcohol is the continuous phase. The shear thickening dispersed phase and the polymer continuous phase in weight ratio between 1:100 to 300:100, respectively.

The aforementioned energy dissipating fiber could be weaved or knitted into tight or elastic fabric and finally could be applied as apparel, home textiles, filters, geo textiles, composites, medical, packing, seatbelts, industrial products, protection, etc. In certain embodiments, two sets of yarn in the warp or weft directions are energy dissipating fiber. In certain embodiments, one set of yarn in the warp or weft directions is energy dissipating fiber and another set of yarn is commercial yarn such as cotton, polyester, nylon and spandex.

Figure 5:
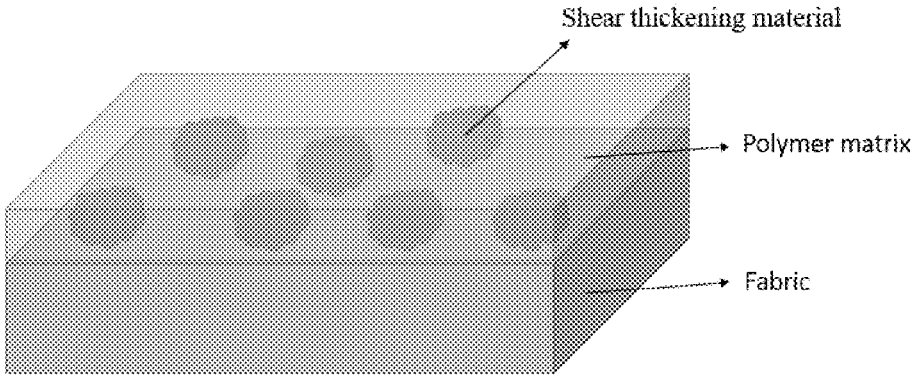
FIG. 5 shows a schematic of a typical energy dissipating fabric
Figure 6:
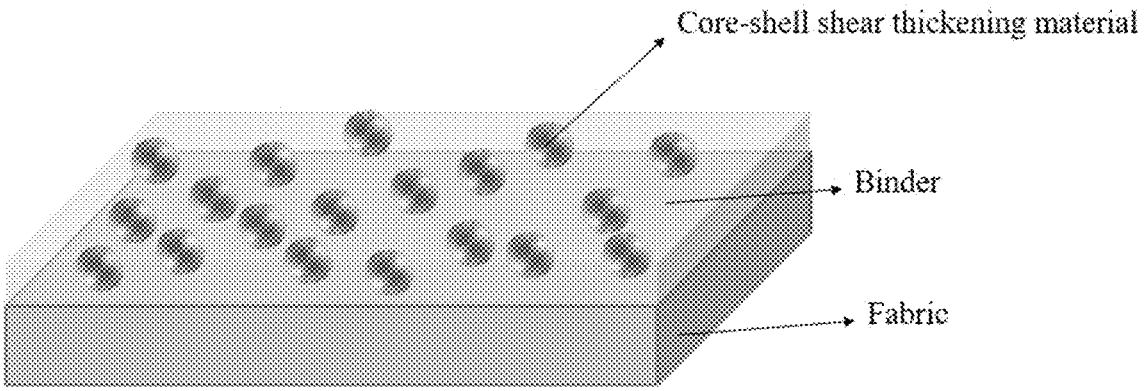
FIG. 6 shows a schematic of a typical energy dissipating fabric with core-shell shear thickening material.

Besides, the energy dissipating fabric can also be prepared by combining the encapsulated shear thickening materials and fabric substrate together. In certain embodiments, encapsulated shear thickening material could be a composite in which shear thickening material is the dispersed phase while a polymer such as silicone rubber, polyurethane, polyvinyl alcohol is the continuous phase. The encapsulated shear thickening material could be coated or laminated onto the fabric to form the energy dissipating fabric as shown in FIG. 5. In certain embodiments, encapsulated shear thickening material could be particle with core-shell structure. The encapsulated shear thickening material could be mixed with binder such as PVDF and PVA to form a coating or film and then print or laminated onto the fabric as shown in FIG. 6.

EXAMPLES

Figure 4:
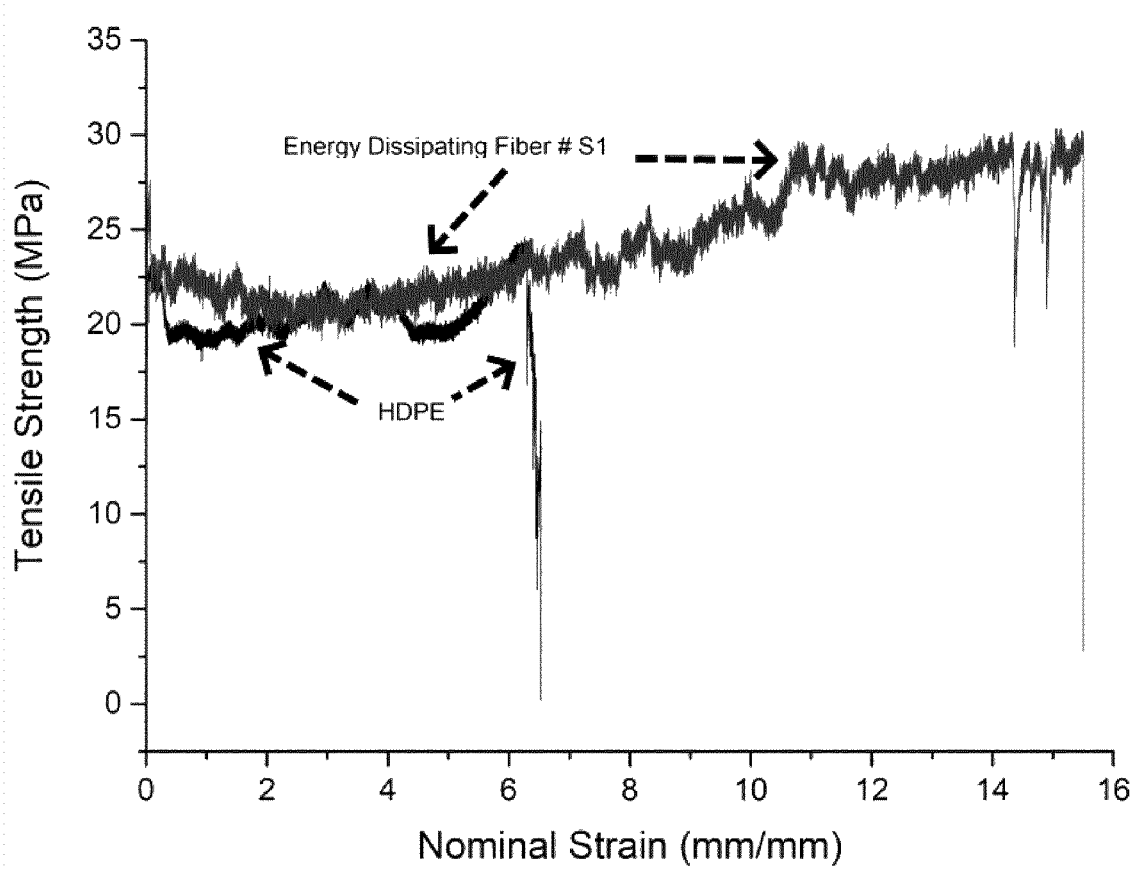
FIG. 4 shows a stress-strain curve of HDPE vs. energy dissipating fiber.

Example 1: Energy dissipating fiber including thermoplastic resin, encapsulated shear thickening material with core-shell structure and reinforcing filler can be prepared as follows. Firstly, high density polyethylene, encapsulated polyborodimethylsiloxane and carbon nanotube are blended together in weight ratio of 100:0.5:0.5 by an internal mixer, and then the composite is cut into small pellets. The core-shell structure, where PBDMS and PMMA respectively serves as the core and shell, has a diameter around 2 μm. The composite pellets are then put into the charging barrel in the melt spinning equipment to form a fiber. The mechanical property of the fiber is tested by a MTS tensile machine and the diameter of fiber is characterized by an optical microscope. Fiber only using high density polyethylene is also fabricated for property comparison. It can be seen from both FIG. 4 and Table 1 that the energy dissipating fiber #S1 sample has higher toughness than the control sample HDPE, which means the energy dissipating fiber could absorb more energy when stretching.

TABLE 1

Summary of mechanical property of HDPE and energy dissipating fiber #S1.

| Sample | Diameter (μm) | Tensile strength (MPa) | Elongation at Break (%) | Toughness ($MJ/m^3$) |
|---|---|---|---|---|
| HDPE | 69 | 25 | 650 | 134 |
| Energy dissipating fiber # S1 | 100 | 30 | 1500 | 357 |

Example 2: Energy dissipating fabric is formed with a plain weave using energy dissipating fiber as either a warp yarn, weft yarn, or both. The dimension of the fabric is around 5×4 cm. Energy dissipating fiber herein includes isotactic polypropylene and encapsulated polyborodimethylsiloxane core-shell particle (where PBDMS and PMMA respectively serves as the core and shell, has a diameter around 2 μm) in weight ratio of 100:0.5 could be prepared by melt spinning. Two types of woven fabric using the energy dissipating fiber are named as IPP+ EDF (Warp/Weft) and Cotton (Warp)/EDF (Weft). The energy dissipating capability of the fabric has been evaluated by a drop weight test. The drop height is 1050 mm from the sensor and the ball weight is 126.66 grams. As shown in the table, two types of energy dissipating fabric shows energy dissipating capacity of about 10.3% and 15.3%, respectively. The protection performance of the energy dissipating fabric is obviously better than other commercial fabrics.

TABLE 2

Summary of energy dissipating capacity of commercial fabric and energy dissipating fabric.

| Sample | Thickness (mm) | Transmitted force (N) | Energy dissipating capacity (%) |
|---|---|---|---|
| Air | 0 | 2408 | 0 |
| Kevlar fabric | 0.58 | 2439 | −1.3 |
| Nylon fabric | 1.11 | 2287 | 5.0 |
| Cotton fabric | 1.11 | 2176 | 9.6 |
| EDF (Warp/Weft) | 0.59 | 2159 | 10.3 |
| Cotton (Warp)/ EDF (Weft) | 1.01 | 2039 | 15.3 |

Figure 7:
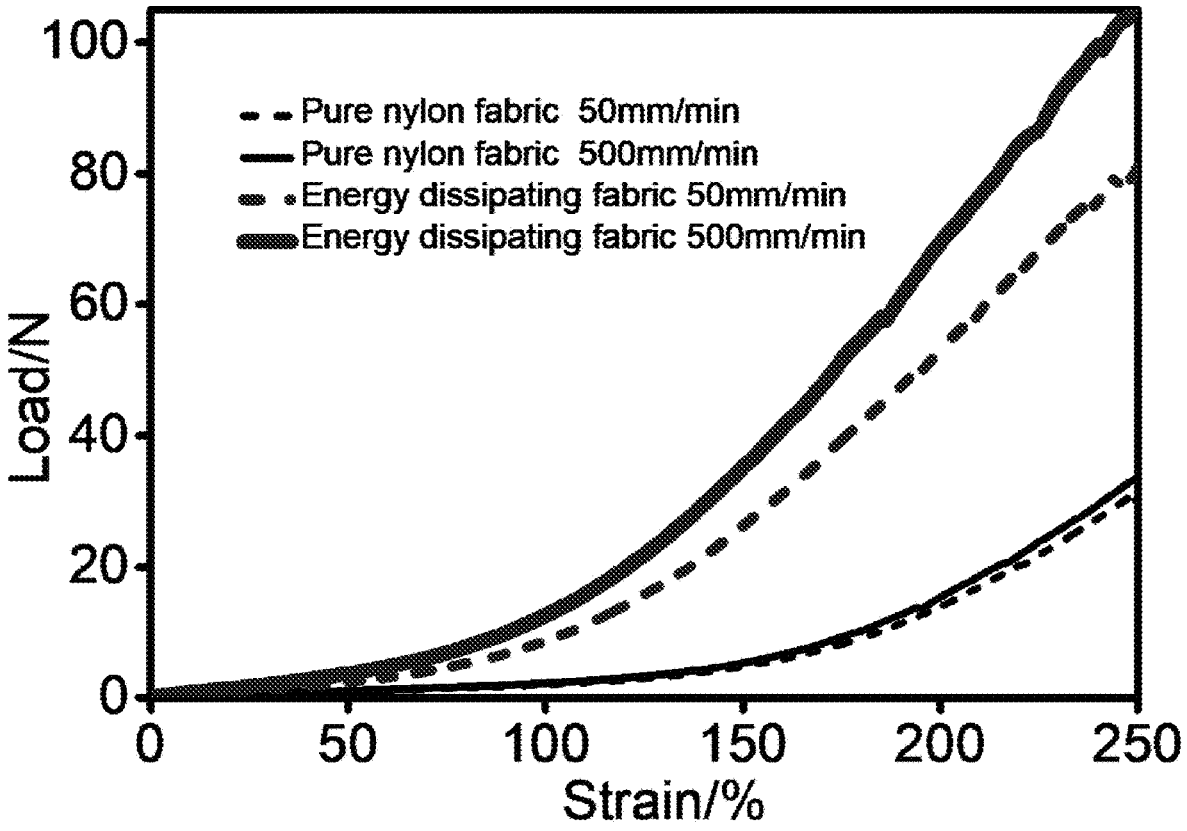
FIG. 7 shows the tensile-strain curves under different stretching rates of energy dissipating fabric and pure nylon fabric. The size of fabric is 70(L)×20(W)×0.5(T) mm.

Example 3: Energy dissipating fabric includes fabric substrate and polymer encapsulated shear thickening material. For the polymer encapsulated shear thickening material, the polyborodimethylsiloxane is dispersed phase and silicone rubber is used as continuous phase. The weight ratio of polyborodimethylsiloxane and silicone rubber is 20:100. The polymer encapsulated shear thickening material is then coated on a nylon fabric and baking at 80° C. for 120 minutes to form energy dissipating fabric. The tensile-strain property of this fabric is tested by a MTS tensile tester under two different stretching rates of 50 mm/min and 500 mm/min. It can be seen from the FIG. 7 that tensile force of the energy dissipating fabric at stretching rate of 500 mm/min is around 1.3 times than that at stretching rate of 50 mm/min, while no difference in tensile force for pure nylon fabric at different stretching rate. It means that more energy is dissipated in material when it was stretched at higher rate.

What is claimed is:

1. A method of preparing an energy dissipating fiber or fabric comprising:

a) mixing a polymer matrix, a shear thickening material, a reinforcing filler and optionally an antioxidant together to form a composite;

b) feeding the composite obtained from step (a) into a melt or extrusion spinning machine to form the energy dissipating fiber; and c) optionally weaving or knitting the fiber obtained from step (b) into the energy dissipating fabric, wherein the polymer matrix comprises polyethylene, polypropylene, polyamide, polyethylene terephthalate, polylactide, acrylonitrile butadiene styrene, polystyrene, or a combination thereof, and wherein the shear thickening material is an encapsulated shear thickening material comprising a shell at least partially encapsulating a core, wherein the core comprises the shear thickening material and the shell comprises an encapsulating material, wherein the shear thickening material comprises polyborodimethylsiloxane (PBDMS) and the encapsulating material comprises polymethylmethacrylate (PMMA); or the encapsulated shear thickening material comprises a dispersed phase and a continuous phase, wherein the disperse phase comprises the shear thickening material and the continuous phase comprises an encapsulating material, wherein the shear thickening material comprises polyborodimethylsiloxane (PBDMS) and the encapsulating material comprises silicone rubber, wherein the polymer matrix, the shear thickening material, and the reinforcing filler are mixed in a weight ratio between 100:0.1:0.1 to 100:0.5:0.5, respectively, wherein the reinforcing filler comprises carbon nanotubes.

2. The method of claim 1 further comprising the step of mixing a compatibilizer, a lubricant, a plasticizer, a dye, or combinations thereof in step (a).

3. A method of preparing an energy dissipating fiber or fabric comprising:

a) mixing a polymer matrix, a shear thickening material, a reinforcing filler and optionally an antioxidant together to form a composite;

b) feeding the composite obtained from step (a) into a melt or extrusion spinning machine to form the energy dissipating fiber; and c) optionally weaving or knitting the fiber obtained from step (b) into the energy dissipating fabric, wherein the polymer matrix comprises polyethylene, polypropylene, polyamide, polyethylene terephthalate, polylactide, acrylonitrile butadiene styrene, polystyrene, or a combination thereof, and wherein the shear thickening material is an encapsulated shear thickening material comprising a shell at least partially encapsulating a core, wherein the core comprises the shear thickening material and the shell comprises an encapsulating material, wherein the shear thickening material comprises polyborodimethylsiloxane (PBDMS) and the encapsulating material comprises polymethylmethacrylate (PMMA); or the encapsulated shear thickening material comprises a dispersed phase and a continuous phase, wherein the disperse phase comprises the shear thickening material and the continuous phase comprises an encapsulating material, wherein the shear thickening material comprises polyborodimethylsiloxane (PBDMS) and the encapsulating material comprises silicone rubber, wherein the polymer matrix, the shear thickening material, and the reinforcing filler are mixed in a weight ratio of 100:0.5:0.5, respectively, wherein the polymer matrix comprises polyethylene, the shear thickening material comprises the encapsulated shear thickening material comprising polyborodimethylsiloxane (PBDMS) and polymethylmethacrylate (PMMA), and the reinforcing filler comprises carbon nanotubes.

4. A method of preparing an energy dissipating fiber or fabric comprising:

a) mixing a polymer matrix, a shear thickening material, a reinforcing filler and optionally an antioxidant together to form a composite;

b) feeding the composite obtained from step (a) into a melt or extrusion spinning machine to form the energy dissipating fiber; and c) optionally weaving or knitting the fiber obtained from step (b) into the energy dissipating fabric, wherein the polymer matrix comprises polyethylene, polypropylene, polyamide, polyethylene terephthalate, polylactide, acrylonitrile butadiene styrene, polystyrene, or a combination thereof, and wherein the shear thickening material is an encapsulated shear thickening material comprising a shell at least partially encapsulating a core, wherein the core comprises the shear thickening material and the shell comprises an encapsulating material, wherein the shear thickening material comprises polyborodimethylsiloxane (PBDMS) and the encapsulating material comprises polymethylmethacrylate (PMMA); or the encapsulated shear thickening material comprises a dispersed phase and a continuous phase, wherein the disperse phase comprises the shear thickening material and the continuous phase comprises an encapsulating material, wherein the shear thickening material comprises polyborodimethylsiloxane (PBDMS) and the encapsulating material comprises silicone rubber, wherein the polymer matrix and the shear thickening material are mixed in a weight ratio of 100:0.5, respectively, wherein the polymer matrix comprises isotactic polypropylene, and the shear thickening material comprises the encapsulated shear thickening material comprising polyborodimethylsiloxane (PBDMS) and polymethylmethacrylate (PMMA).

5. The method of claim 4, wherein the reinforcing filler comprises talc, boron nitride, calcium carbonate, magnesium carbonate, titanium oxide, carbon nanotubes, ultra-high molecular weight polyethylene (PE), sisal fibers, high-modulus PE fiber, anthracene, potassium hydrogen phthalate, benzoic acid type compounds, sodium benzoate type compounds, zinc monoglycerolate, fumed silica, E-glass fiber, wollastonite, quartz, hydrophobic fumed silica, diatomaceous earth, calcium carbonate, or combinations thereof.

6. A method of preparing an energy dissipating fiber or fabric comprising:

a) mixing a polymer matrix, a shear thickening material, a reinforcing filler and optionally an antioxidant together to form a composite;

b) feeding the composite obtained from step (a) into a melt or extrusion spinning machine to form the energy dissipating fiber; and c) optionally weaving or knitting the fiber obtained from step (b) into the energy dissipating fabric, wherein the polymer matrix comprises polyethylene, polypropylene, polyamide, polyethylene terephthalate, polylactide, acrylonitrile butadiene styrene, polystyrene, or a combination thereof, and wherein the shear thickening material is an encapsulated shear thickening material comprising a shell at least partially encapsulating a core, wherein the core comprises the shear thickening material and the shell comprises an encapsulating material, wherein the shear thickening material comprises polyborodimethylsiloxane (PBDMS) and the encapsulating material comprises polymethylmethacrylate (PMMA); or the encapsulated shear thickening material comprises a dispersed phase and a continuous phase, wherein the disperse phase comprises the shear thickening material and the continuous phase comprises an encapsulating material, wherein the shear thickening material comprises polyborodimethylsiloxane (PBDMS) and the encapsulating material comprises silicone rubber, wherein the encapsulated shear thickening material comprises the dispersed phase comprising polyborodimethylsiloxane (PBDMS) and the continuous phase comprising silicone rubber, wherein polyborodimethylsiloxane (PBDMS) and silicone rubber are in a weight ratio of 20:100, respectively.

7. The method of claim 6, wherein the reinforcing filler comprises talc, boron nitride, calcium carbonate, magnesium carbonate, titanium oxide, carbon nanotubes, ultra-high molecular weight polyethylene (PE), sisal fibers, high-modulus PE fiber, anthracene, potassium hydrogen phthalate, benzoic acid type compounds, sodium benzoate type compounds, zinc monoglycerolate, fumed silica, E-glass fiber, wollastonite, quartz, hydrophobic fumed silica, diatomaceous earth, calcium carbonate, or combinations thereof.

* * * * *